US011496822B2

(12) United States Patent
Seo et al.

(10) Patent No.: US 11,496,822 B2
(45) Date of Patent: Nov. 8, 2022

(54) MICROPHONE MOUNTING STRUCTURE FOR HEADSET

(71) Applicant: BUJEON CO., LTD., Ansan-si (KR)

(72) Inventors: Donghyun Seo, Ansan-si (KR); Ki-Bum Bang, Hwaseong-si (KR); Sunwoo Park, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 17/306,404

(22) Filed: May 3, 2021

(65) Prior Publication Data

US 2022/0014832 A1 Jan. 13, 2022

(30) Foreign Application Priority Data

Jul. 10, 2020 (KR) ..... 10-2020-0085242

(51) Int. Cl.

| | |
|---|---|
| ***H04R 1/10*** | (2006.01) |
| ***H04R 1/04*** | (2006.01) |
| ***H04R 1/08*** | (2006.01) |
| ***H04R 5/033*** | (2006.01) |

(52) U.S. Cl.

CPC ..... *H04R 1/10* (2013.01); *H04R 1/04* (2013.01); *H04R 1/08* (2013.01); *H04R 5/033* (2013.01)

(58) Field of Classification Search

CPC ... H04R 1/10; H04R 1/04; H04R 1/08; H04R 5/033; H04R 1/1075; H04R 1/1016; H04R 2201/003; H04R 2225/025

See application file for complete search history.

(56) References Cited

U.S. PATENT DOCUMENTS

2013/0221457 A1* 8/2013 Conti ..... H04R 19/04 438/51
2017/0318401 A1* 11/2017 Chang ..... H04R 1/1075

FOREIGN PATENT DOCUMENTS

KR 10-2007-0069440 A 7/2007
KR 10-2017-0123818 A 11/2017

* cited by examiner

*Primary Examiner* — Kile O Blair
(74) *Attorney, Agent, or Firm* — Korus Patent, LLC; Seong Il Jeong

(57) ABSTRACT

The present invention provides a microphone mounting structure for a headset, the microphone mounting structure comprising: a housing surrounding the headset and forming an audio output channel along a vertical direction inside; a microphone mounted along the vertical direction inside a space formed by the audio output channel, and a substrate connected to a main board and including a supporting part mounted in a rear side of the microphone, wherein the microphone includes a circuit substrate formed in a rear side of the microphone, and the circuit substrate includes a hole, wherein the supporting part includes a substrate hole communicating the hole.

9 Claims, 8 Drawing Sheets

MICROPHONE MOUNTING STRUCTURE FOR HEADSET

FIELD OF THE INVENTION

The present invention relates to a microphone mounting structure for a headset and more particularly, to an improved microphone mounting structure for a headset, especially for a TWS (True Wireless Stereo) product, enhancing sound quality, water resistance, and durability thereof.

BACKGROUND OF THE INVENTION

A speaker is an electronic product outputting sound by converting an electronic signal to a form of sound wave, which uses the principle opposite to that used in a microphone. When currents flow through a coil, the magnet becomes an electromagnet having its own magnetic field. Interacting with peripheral magnetic fields, the electromagnet generates forces of attraction and repulsion, thereby alternatively pulling or pushing the sound wave, vibrating a diaphragm, and producing sound wave.

According to recent developments in a headset, especially a TWS product, a hybrid-type wireless headset has been widely used, which has a function that a user can deliver their voice using a microphone mounted inside the headset. The voice of a user is generated from a vibration of their vocal cord; this vibration arrives to the ear via the auditory cells and the inner ear from the vocal cord, and it is also delivered to the external auditory meatus of the ear as external sounds through vocalization. When a microphone senses the vibration as analog sound, the sound is converted to an electronic signal through an electronic substrate such as a PCB, and is transmitted to an external device, such as an earphone of a counterpart user. The speaker of the counterpart user converts the electronic signal to audio signal, and deliver it to the external auditory meatus of the ear.

Korean Patent No. 10-1835353 is related to an electronic device with a built-in microphone, which discloses a structure of a microphone mounted in an opposite side of an audio output channel of a head set, which is inserted to the ear of a user. Korean Patent No. 10-1892263 discloses a structure comprising a small size microphone mounted in the rear side of an audio output channel of a headset housing, and a shielding member that blocks the audio of a speaker and prevents the audio from being delivered to the microphone, thereby removing noise caused by the speaker. Korean Patent No. 10-2002784 discloses a structure that microphones are disposed in a front side and a rear side of a housing, respectively. The microphone in the front side collects sound delivered to the ear of a user, and the microphone in the rear side collects external noises and filters them. Korean Application Publication No. 10-2017-0123818 discloses a structure of a microphone installed in one side of an audio output channel of a housing. Specifically, the microphone is installed in a space, which is closed with regard to a main path of the audio output channel, to avoid disturbing audio signals from a speaker; however, the installment of the structure is too complicated.

These prior arts commonly have drawbacks that the installment of the microphone structure for preventing interference with the speaker is too complicated to design and manufacture, is not effective to exclude exterior noises, and does not have water resistance and durability functions.

To solve these problems, inventors devised an improved microphone mounting structure for a headset, especially for a TWS (True Wireless Stereo) product, enhancing sound quality, water resistance, and durability thereof.

Accordingly, the object of the invention is to provide a microphone mounting structure for a headset, which enables a microphone to be easily mounted on a wearable device, such as a headset, and to have good water resistance and durability properties.

SUMMARY OF THE INVENTION

The present invention provides a microphone mounting structure for a headset, the microphone mounting structure comprising: a housing surrounding the headset and forming an audio output channel along a vertical direction inside; a microphone mounted along the vertical direction inside a space formed by the audio output channel, and a substrate connected to a main board and including a supporting part mounted in a rear side of the microphone, wherein the microphone includes a circuit substrate formed in a rear side of the microphone, and the circuit substrate includes a hole, wherein the supporting part includes a substrate hole communicating the hole.

A speaker driver is installed inside the housing, and wherein the substrate is mounted on an audio output surface of the speaker driver, and comprises: a ring part having an opening in the center thereof, a supporting part bending downward from one point of the ring part, and a connecting part extending toward the main board from the ring part.

The microphone mounting structure further comprises an upper plate mounted between the audio output surface and the substrate and including: an upper ring part having the same shape as the ring part, and an upper supporting part having the same shape as the supporting part.

The microphone mounting structure further comprises a lower plate, wherein the lower plate includes a lower ring part having the same shape as the ring part, and is mounted to be overlapped and meet with a bottom side of the ring part.

The hole comprises a plurality of holes, wherein a sum of diameters of the plurality of the holes ranges from 1 um to 500 um.

The plurality of the holes includes a center hole, and a plurality of periphery holes surrounding the center hole.

In addition, The present invention provides microphone mounting structure for a headset, the microphone mounting structure comprising: a housing surrounding the headset and forming an audio output channel along a vertical direction inside; a speaker driver and a battery mounted inside the housing, wherein an audio output surface of the speaker driver is perpendicular to the vertical direction, and a microphone mounted along the vertical direction inside a space formed by the audio output channel.

DETAILED DESCRIPTION EMBODIEMENTS OF THE INVENTIONS

The purposes, technical effects, and technical elements of the present invention will be clarified by embodiments described in detail later in conjunction with the accompanying drawings. Detailed explanation regarding related elements or functions, which are well known to one of ordinary skill in the art, will be omitted in case it may obscure the gist of the present invention.

In this specification, when a portion "comprises" and/or "includes" an element, it does not mean to preclude the presence or addition of one or more other elements and/or components unless the context clearly indicates otherwise. Meanwhile, in embodiments of the present invention, each element, component, functional block, or mean may be composed of one or more of subordinate elements.

Figure 1:
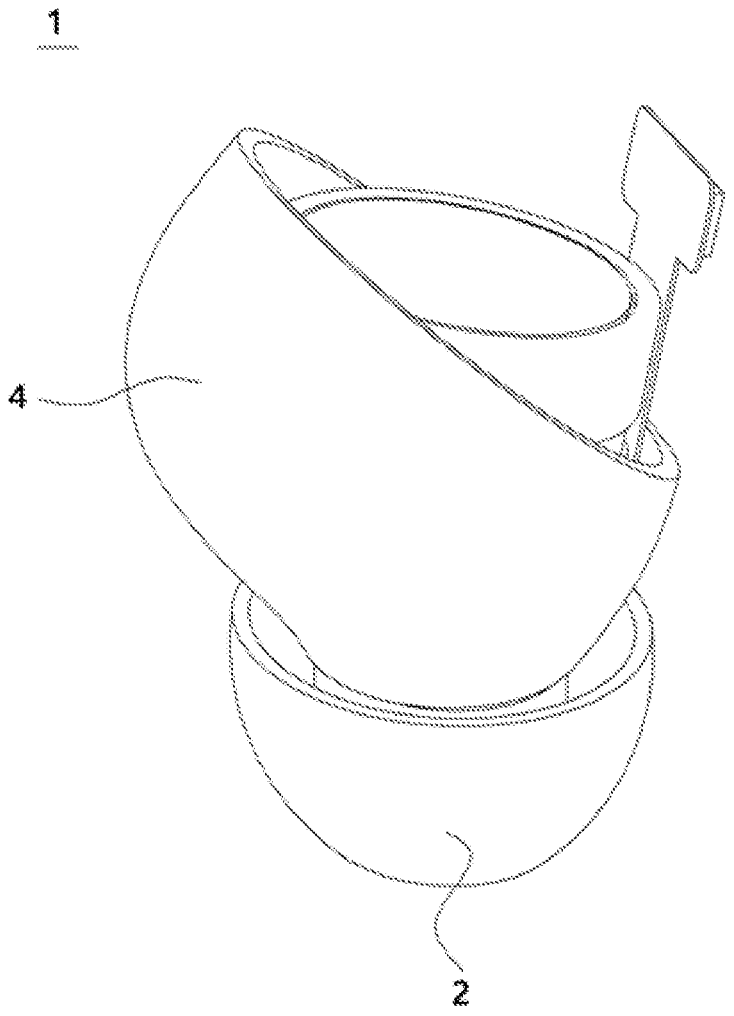
FIG. 1 is an exterior perspective view of a headset of the present invention.

FIG. 1 is an exterior perspective view of a headset 1 of the present invention. Desirably, the headset 1 is a TWS type wireless headset, such as a headset using Bluetooth. Since the headset includes various electronic parts such as a microphone as well as a speaker, the headset may be a wearable electronic device, which is mounted on the ear, in a broad sense.

The headset 1 comprises a housing 4 forming most of an exterior view, an earpiece or an ear tip 2 connected to an audio output channel 16 of the housing 4.

Figure 2:
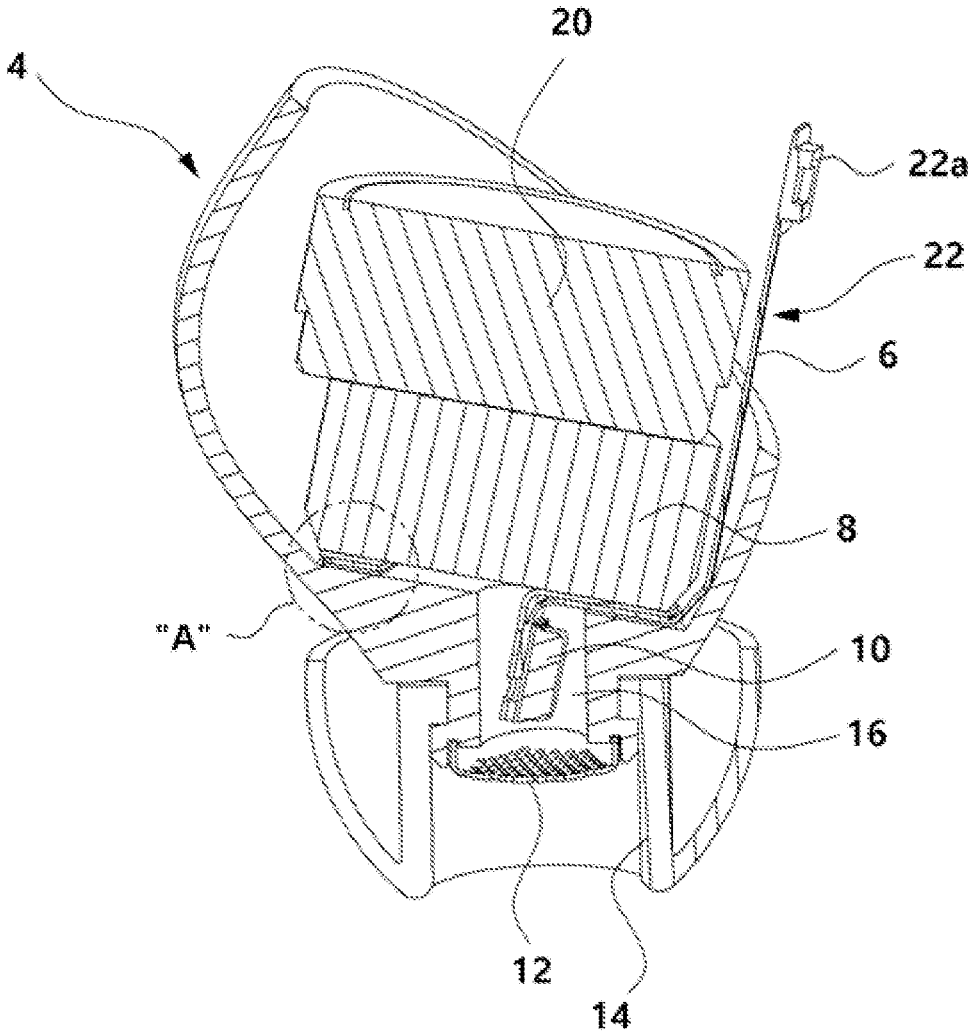
FIG. 2 is a cross-sectional view taken along a center cut line in a longitudinal direction of the headset of FIG. 1.

FIG. 2 is a cross-sectional view taken along a center cut line in a longitudinal direction of the headset of FIG. 1.

A battery 20 and a speaker driver 8 are arranged in turn from a top inside the housing 4. Components such as a coil, a diaphragm, and a magnet are mounted inside the driver 8. The audio output channel 16 having a narrow circle shape is formed along a vertical direction toward a front side of the housing 4, which is a bottom side of FIG. 2. A filter 12 filtering alien substances is installed in a front side of the audio output channel 16. The ear tip 2 surrounds the outer side of the audio output channel 16 and is mounted on the housing 4. The sound wave output from the driver 8 is delivered into the external auditory meatus of a user through the audio output channel 16 and the ear tip 2. The shape and the structure of the housing 4 and the ear tip 2 are not limited to the embodiments shown in the drawings and can be modified.

As shown in FIG. 2, one of the characteristics of the present invention is that the microphone 10 is disposed in a path or a space of the audio output channel 16. The microphone 10 is mounted on a substrate 22 such as FPCB (Flexible Print Circuit Board). A main board 22*a* is formed on the top of the substrate 22 as one body. The substrate 22 delivers a power signal to operate the microphone 10 and delivers an audio signal, which the microphone receives, to the main board 22*a*. It is desired that the microphone 10 is an ANC microphone having a noise prevention function but is not limited to. The microphone 10 is installed in a vertical direction perpendicular to an audio output surface of the driver 8.

Figure 3:
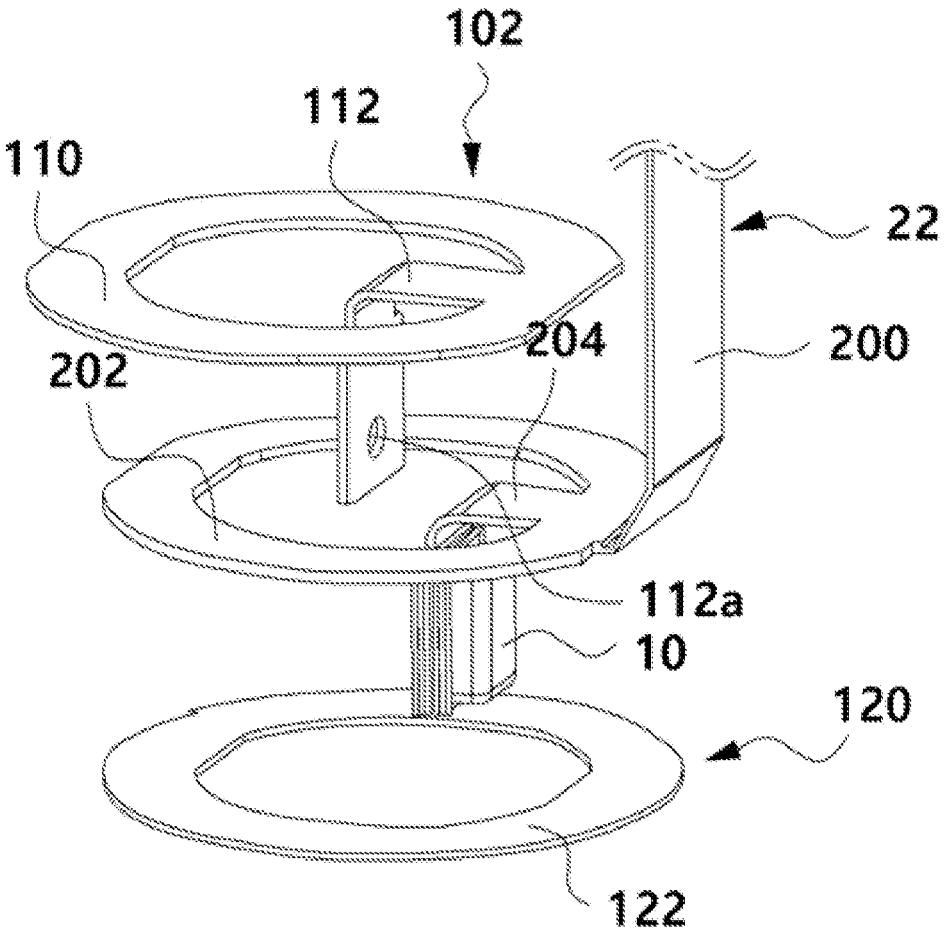
FIG. 3 is an exploded perspective view showing components supporting a microphone of the present invention.

FIG. 3 is an exploded perspective view showing components supporting the microphone 10 of the present invention.

The substrate 22 is mounted on the audio output surface of the driver 8, which is the bottom side of the driver 8, and comprises: a ring part 202 having an opening in the center thereof, a supporting part 204 extending from one point of the ring part 202 and bending downward in a vertical direction, and a connecting part 200 extending upward toward the main board 22*a* from the ring part 202 in a vertical direction. The microphone 10 is mounted on the supporting part 204.

An upper plate 102 comprises an upper ring part 110 having the same shape as the ring part 202, and an upper supporting part 112 having the same shape as the supporting part 204. The upper plate 102 is mounted in direct contact with the bottom side of the driver 8; corresponding parts of the substrate 22 are overlapped with the plate 102 without dislocation and meets with the bottom side of the plate 102, thereby guiding the microphone 10 to be mounted inside the audio output channel 16.

A lower plate 120 comprises a lower ring part 122 having the same shape as the ring part 202, and is mounted to be overlapped and meet with the bottom side of the ring part 202, thereby reinforcing the hardness of the corresponding parts of the substrate 22.

The upper and the lower plate 102, 120 prevent the soft FPCB from being deformed or damaged between the housing 4 and the driver 8. The upper and the lower plate 102, 120 may be made of a metal plate, such as SUS, or a plastic film. In case the substrate 22 is made of rigid materials, one or more of the upper and the lower plate 102, 120 can be omitted. Other than embodiment shown in the drawings, the supporting part 204 supporting the microphone 10 can be directly connected to the connecting part 200. In this instance, the ring part 202 can be omitted. In addition, in FIG. 2, the supporting part 204 is formed in the right side of the ring part 202, but can be formed in any location of the ring part 202 according to the shape and the mounting location of the substrate 22. If the shape and the structure of the substrate 22 are changed, the upper and the lower plate 102, 120 are modified accordingly.

Figure 4:
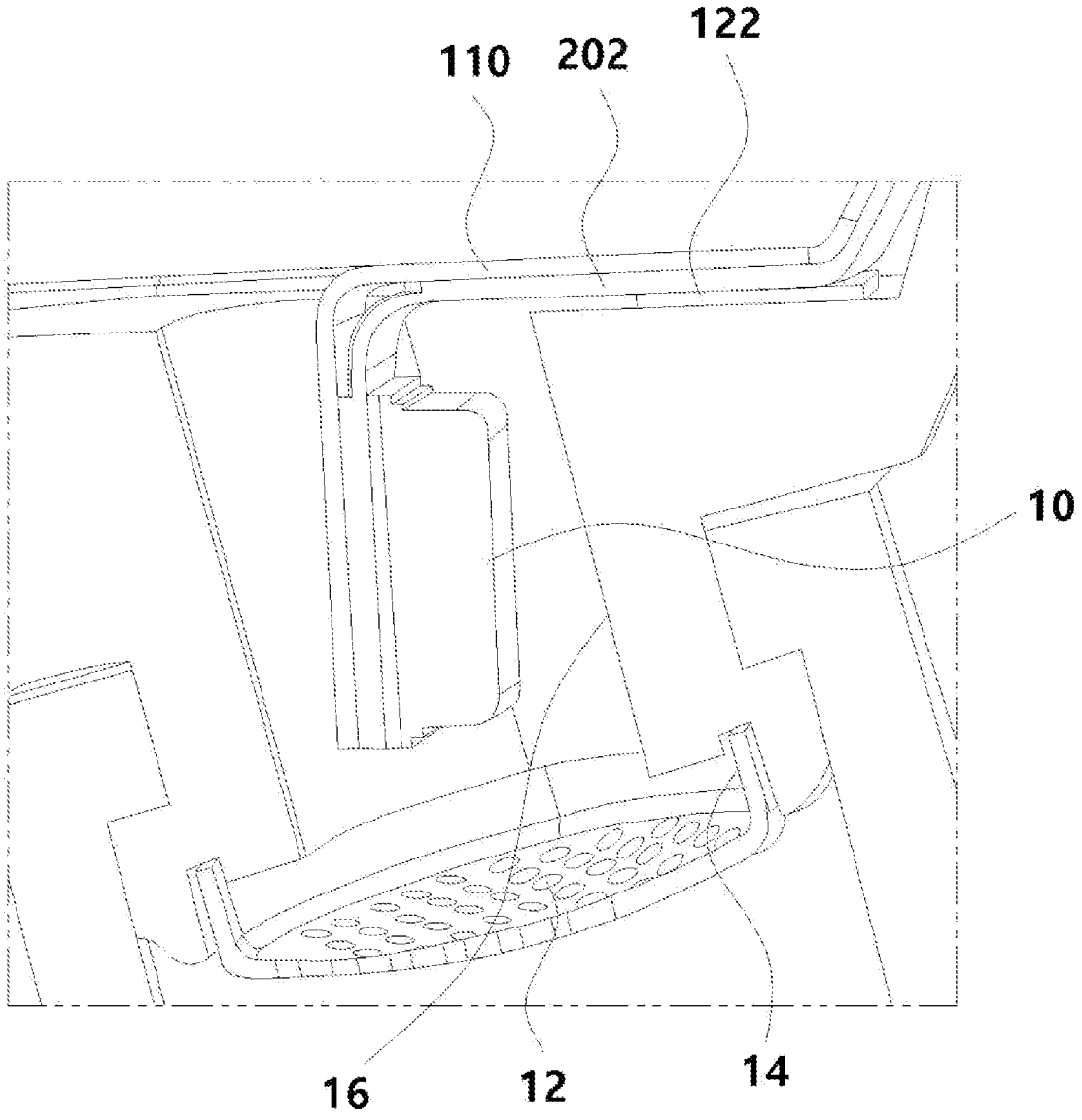
FIG. 4 is a perspective view showing a microphone mounted inside a space of an audio output channel of the present invention.

FIG. 4 is a perspective view showing a microphone 10 mounted inside a space of the audio output channel 16 of the present invention.

The microphone 10 is mounted along a vertical direction in such a way that a rear side thereof (a left side of the microphone 10 in FIG. 4) is on the supporting part 204 of the substrate 22, and a front side thereof (a right side of the microphone 10 in FIG. 4) faces a wall of the audio output channel 16. The upper supporting part 112 is located in the rear side of the supporting part 22. The upper ring part 102, the ring part 202, and the lower ring part 122 are located in turn from the top between the audio output surface of the driver 8 and the housing 4. The upper and the lower plate 102, 120 may be designed to further comprise corresponding parts to the connecting part 200, thereby reinforcing the substrate 22 between the lateral side of the driver 8 and the housing 4.

The microphone mounting structure for a headset of the present invention does not need an extra space inside the housing 4 for mounting the microphone, thereby enabling an easy manufacturing process. In addition, the microphone 10 can be easily mounted on using the space of the audio output channel 16. Furthermore, the substrate 22 can be reinforced by installing the plates, thereby enhancing durability thereof. Moreover, since the microphone 10 is installed in proximity to the ear of a user, the microphone can clearly receive sound wave, which vibrates in the ear.

Hereafter, a waterproof function of the microphone 10 mounting structure will be described.

Figure 8:
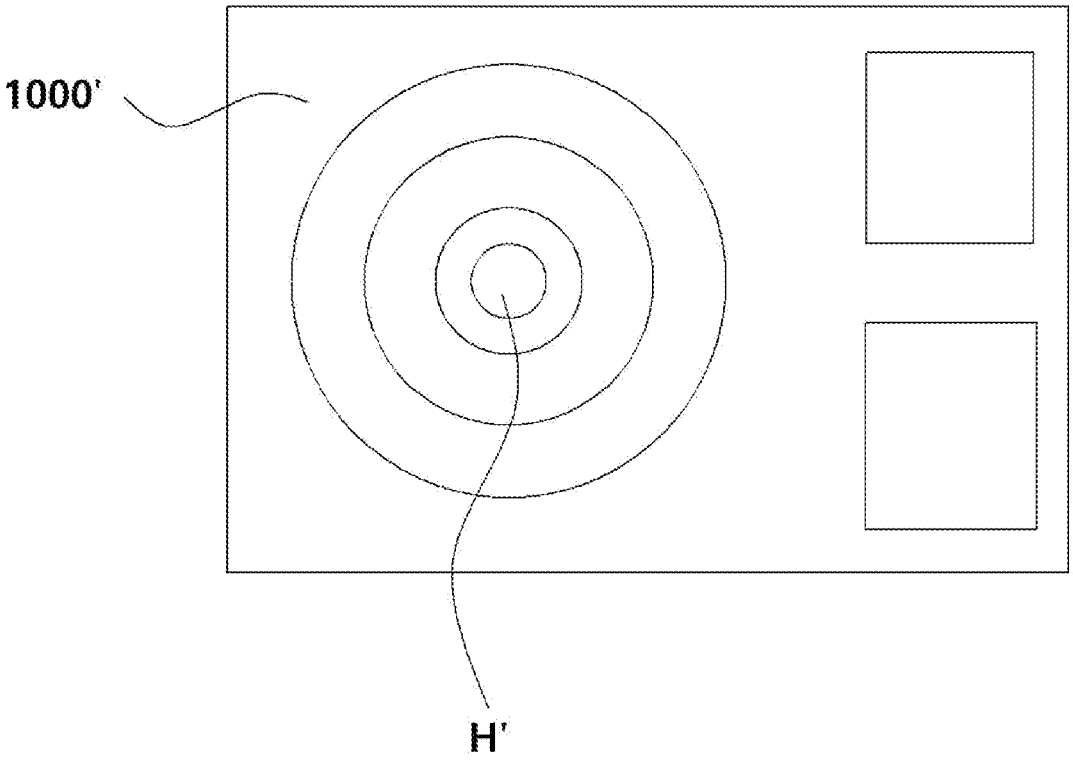
FIG. 8 is a drawing of a front circuit substrate of a microphone of the current technology.

FIG. 8 is a drawing of a front circuit substrate 1000' of a microphone, which is currently widely used. A hole H' is formed in the substrate 1000', through which sound passes and enters. The diameter of the hole H' is at least 500 um or more. However, in this case, water can permeate and soak into components inside the microphone, thereby deteriorating quality thereof. This is a main cause of disorder in the microphone.

Figure 7:
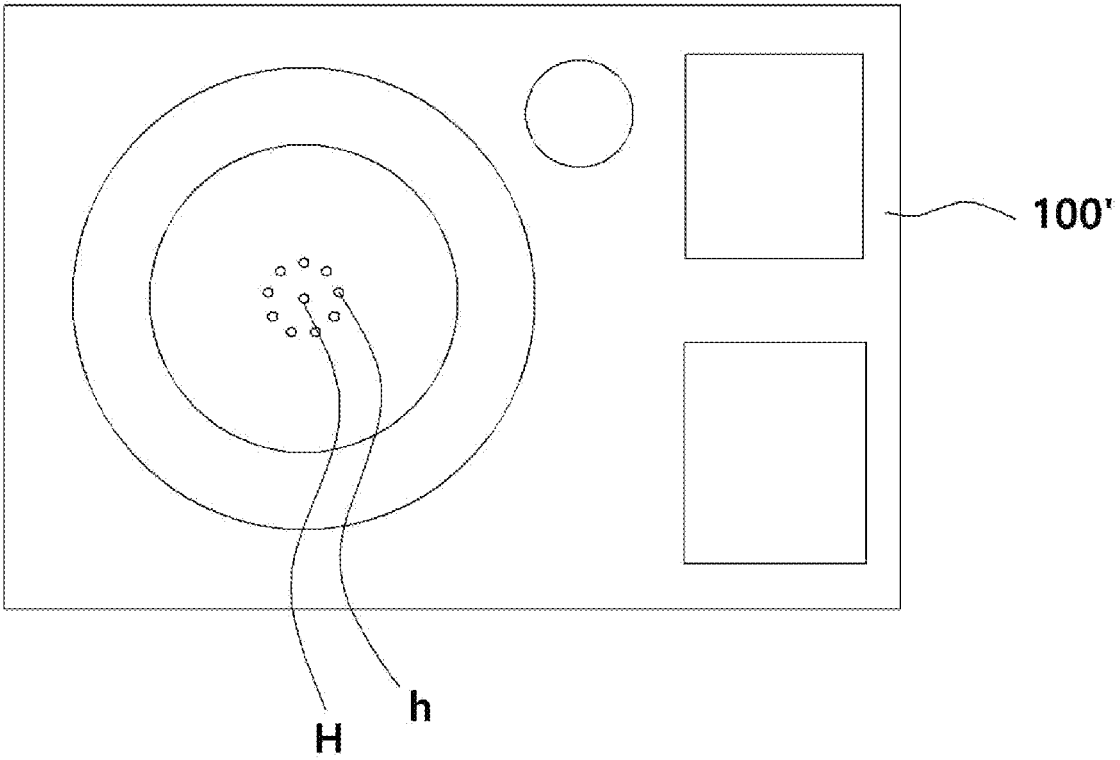
FIG. 7 is a drawing of a front circuit substrate of a microphone of the present invention.

To prevent these problems, referring to FIG. 7, the front circuit substrate 100' included in the microphone 10 comprises a center hole H and a plurality of periphery holes h surrounding the center hole H. The sum of the diameters of the holes is not higher than 500 um at the maximum value, and can be 1 um at the minimum value. Since it is known that the smallest size of a water drop has the diameter of 1 um, the microphone 10 having multiple holes each having a small diameter can block most of water that permeates into the microphone 10. The number and the arrangement of the hole in FIG. 4 are one embodiment of the present invention, and various modifications are possible. In another embodiment, the center hole H may be omitted, and a plurality of periphery holes h may be compactly arranged at equal spaces.

Figure 5:
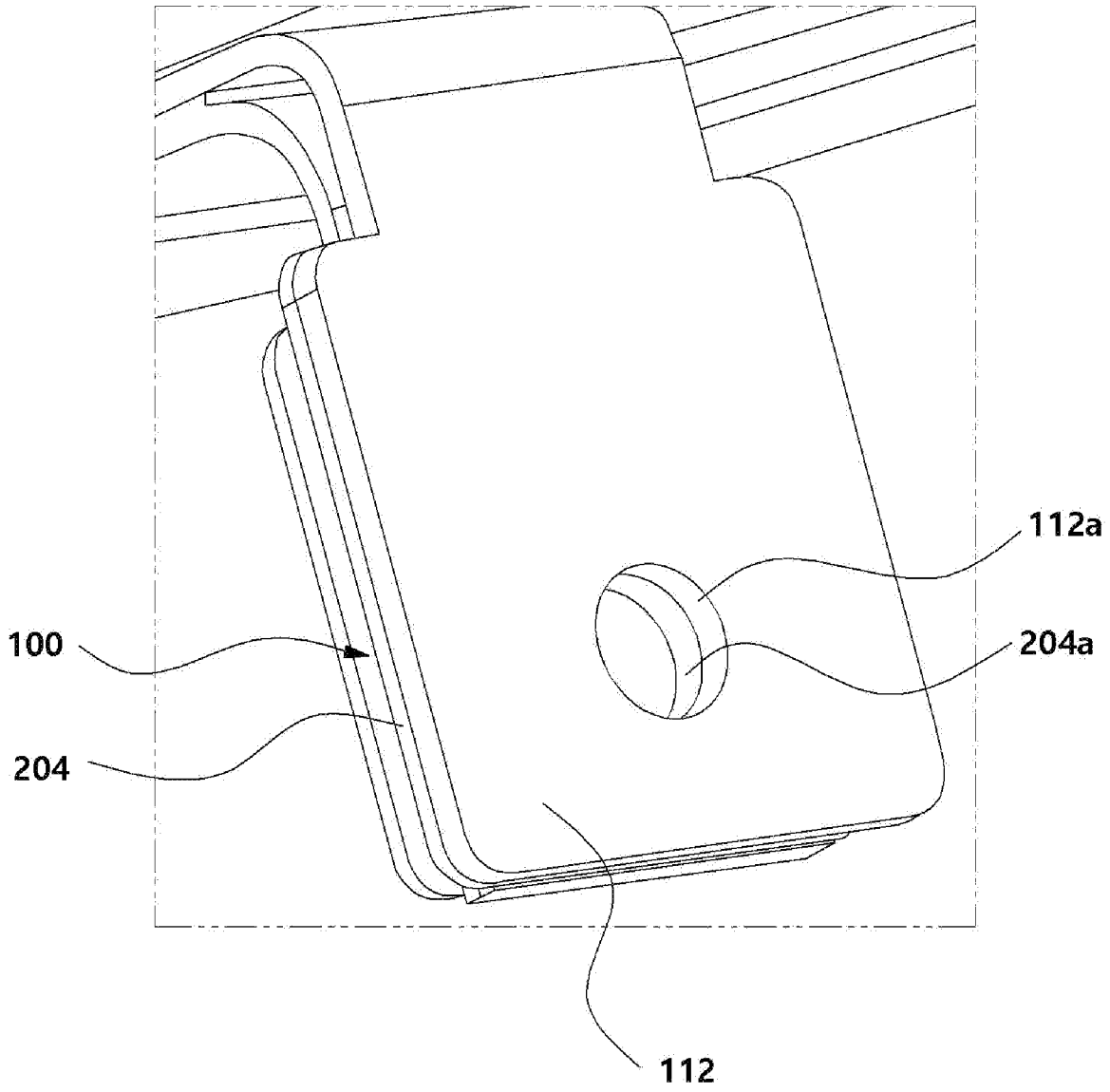
FIG. 5 is a side view of a substrate and an upper plate designed for a waterproof structure of a microphone of the present invention.
Figure 6:
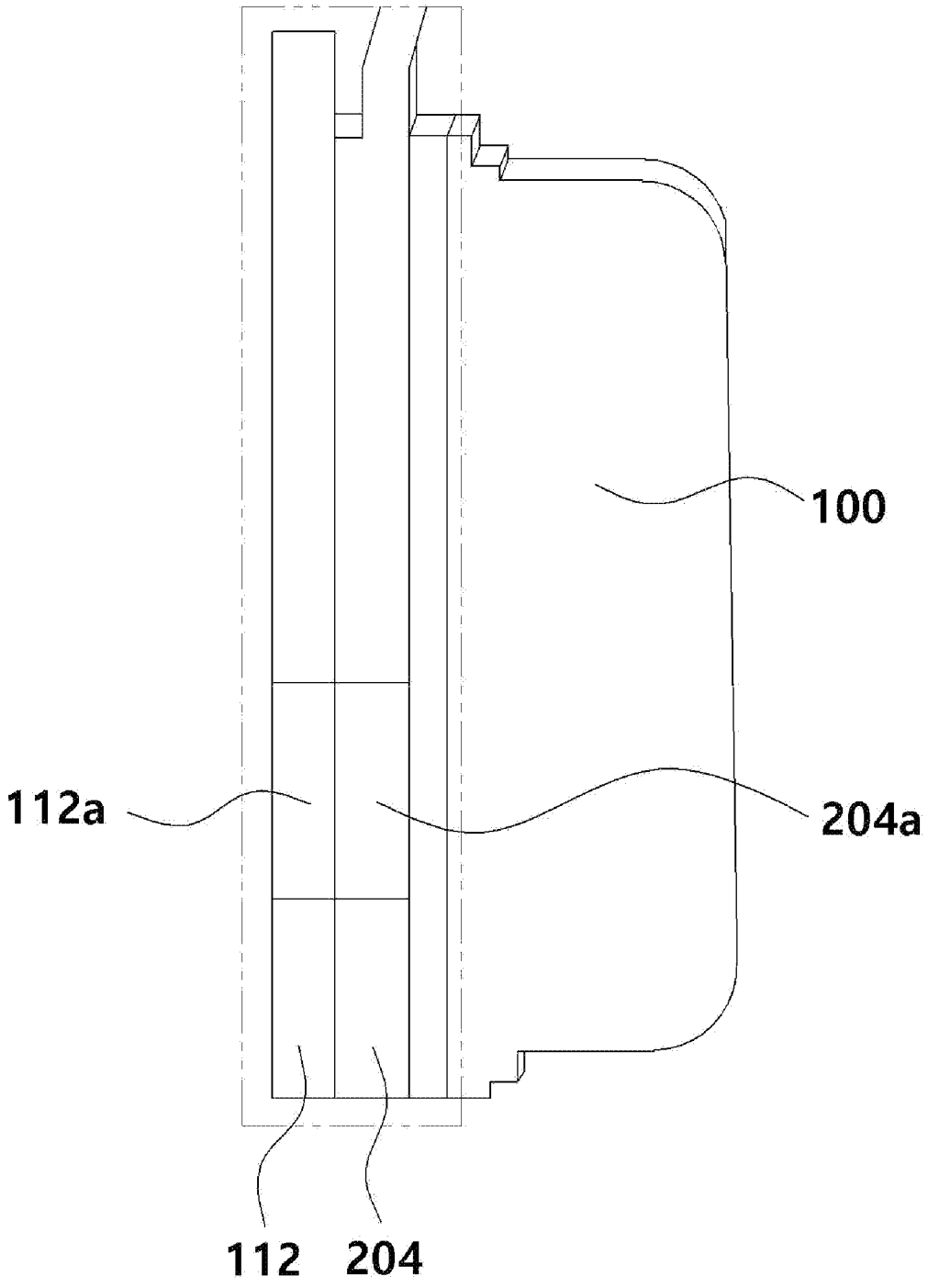
FIG. 6 is a front perspective view of a substrate and an upper plate designed for a waterproof structure of a microphone of the present invention.

FIGS. 5 and 6 are a side view and a front perspective view of the substrate 22 and the upper plate 102 designed for a waterproof structure of a microphone 10 of the present invention of FIG. 7.

Referring to FIGS. 5 and 6, a substrate hole 204*a* is formed in the supporting part 204, corresponding to the hole of the microphone 10, and a plate hole 112*a* is formed in the supporting part 112 of the upper plate 102. Each of the substrate hole 204*a* and the plate hole 112 is single, and it is desired that the size of each of the substrate hole 204*a* and the plate hole 112 is enough to communicate with the entirety of holes H and h. In another embodiment, each of the substrate hole 204*a* and the plate hole 112 may comprise a plurality of holes.

While embodiments of the present invention have been described, the present invention is not limited to what has been particularly shown. It would be apparent that many more modifications and variations than mentioned above are possible by an ordinary person skilled in the art.

What is claimed is:

1. A microphone mounting structure for a headset, the microphone mounting structure comprising:

a housing surrounding the headset and forming an audio output channel along a vertical direction inside;

a microphone mounted along the vertical direction inside a space formed by the audio output channel, and a substrate connected to a main board and including a supporting part mounted in a rear side of the microphone, wherein the microphone includes a circuit substrate formed in a rear side of the microphone, and the circuit substrate includes a hole, wherein the supporting part includes a substrate hole which communicates with the hole, wherein a speaker driver is installed inside the housing, and wherein the substrate is mounted on an audio output surface of the speaker driver, and comprises:

a ring part having an opening in the center thereof, the supporting part extending from one point of the ring part, and a connecting part extending toward the main board from the ring part.

2. The microphone mounting structure of claim 1, the microphone mounting structure further comprises an upper plate mounted between the audio output surface and the substrate and including:

an upper ring part having the same shape as the ring part, and an upper supporting part having the same shape as the supporting part.

3. The microphone mounting structure of claim 2, wherein the hole comprises a plurality of holes, wherein a sum of diameters of the plurality of the holes ranges from 1 um to 500 um.

4. The microphone mounting structure of claim 3, wherein the plurality of the holes includes a center hole, and a plurality of periphery holes surrounding the center hole.

5. The microphone mounting structure of claim 1, the microphone mounting structure further comprises a lower plate, wherein the lower plate includes a lower ring part having the same shape as the ring part, and is mounted to be overlapped and meet with a bottom side of the ring part.

6. The microphone mounting structure of claim 5, wherein the hole comprises a plurality of holes, wherein a sum of diameters of the plurality of the holes ranges from 1 um to 500 um.

7. The microphone mounting structure of claim 6, wherein the plurality of the holes includes a center hole, and a plurality of periphery holes surrounding the center hole.

8. The microphone mounting structure of claim 1, wherein the hole comprises a plurality of holes, wherein a sum of diameters of the plurality of the holes ranges from 1 um to 500 um.

9. The microphone mounting structure of claim 8, wherein the plurality of the holes includes a center hole, and a plurality of periphery holes surrounding the center hole.

* * * * *